US009474319B2

(12) United States Patent
Ahlgren et al.

(10) Patent No.: US 9,474,319 B2
(45) Date of Patent: Oct. 25, 2016

(54) PIVOTING HEADGEAR SYSTEM

(75) Inventors: Lars-Olov Ahlgren, Fellingsbro (SE); Niklas M. S. Lilenthal, Leksand (SE); Arne O. Linderstrand, Leksand (SE)

(73) Assignee: 3M Innovative Properties Company, St. Paul, MN (US)

( * ) Notice: Subject to any disclaimer, the term of this patent is extended or adjusted under 35 U.S.C. 154(b) by 739 days.

(21) Appl. No.: 12/681,858

(22) PCT Filed: Oct. 6, 2008

(86) PCT No.: PCT/US2008/078920

§ 371 (c)(1),
(2), (4) Date: Apr. 6, 2010

(87) PCT Pub. No.: WO2009/048836

PCT Pub. Date: Apr. 16, 2009

(65) Prior Publication Data

US 2010/0229274 A1 Sep. 16, 2010

(51) Int. Cl.
*A42B 3/22* (2006.01)
*A42B 3/14* (2006.01)

(52) U.S. Cl.
CPC *A42B 3/225* (2013.01); *A42B 3/14* (2013.01)

(58) Field of Classification Search
CPC ..... A42B 3/14; A42B 3/225
USPC ..... 2/6.3, 6.5, 8.1–8.3, 9, 209, 209.13, 2/416–418, 422, 424, 2.6, 6.7, 410; 128/201.24, 206.23, 857; 602/207.11
See application file for complete search history.

(56) References Cited

U.S. PATENT DOCUMENTS

| | | | | |
|---|---|---|---|---|
| 1,182,367 | A * | 5/1916 | Gravell | 2/8.2 |
| 1,338,022 | A | 4/1920 | Lamoreaux | |
| 2,016,775 | A * | 10/1935 | Gingg | 2/8.2 |
| 3,047,876 | A * | 8/1962 | Malcom, Jr. | 2/9 |
| 3,074,072 | A * | 1/1963 | Edwards et al. | 2/8.1 |
| 3,075,201 | A * | 1/1963 | Lindblom | 2/8.1 |

(Continued)

FOREIGN PATENT DOCUMENTS

| | | |
|---|---|---|
| CN | 2169293 | 6/1994 |
| CN | 2507431 | 8/2002 |

(Continued)

OTHER PUBLICATIONS

Jackson, Eastern Welding Supply, 2002, pp. 226-258.

(Continued)

*Primary Examiner* — Katherine Moran
(74) *Attorney, Agent, or Firm* — Kenneth B. Wood

(57) ABSTRACT

A pivoting protective headgear system includes a head suspension and two pivots coupled to the head suspension. A protective headgear element is pivotally connected to each pivot. In one exemplary embodiment, two transition arms are coupled to the head suspension and extend longitudinally extending away from the head suspension, and each transition arm has a distal end and a pivot at the distal end. In another exemplary embodiment, two pivots are coupled to the head suspension and each pivot has an axis of rotation configured to be below any portion of an ear of a user. In a further exemplary embodiment, two pivots are each spaced apart from the headband and coupled to the headband, and the headband is configured to be disposed against a forehead of a user and each pivot has an axis of rotation below the headband.

9 Claims, 3 Drawing Sheets

(56) References Cited

U.S. PATENT DOCUMENTS

| | | | | | |
|---|---|---|---|---|---|
| 3,137,005 | A | * | 6/1964 | Herbine et al. | 2/10 |
| 3,763,495 | A | | 10/1973 | DeAngelis | |
| 3,866,244 | A | * | 2/1975 | Ruck | 2/8.1 |
| 3,868,727 | A | | 3/1975 | Paschall | |
| 4,000,520 | A | | 1/1977 | Svendsen | |
| 4,536,892 | A | * | 8/1985 | Brinkhoff et al. | 2/424 |
| 4,796,307 | A | * | 1/1989 | Vantine | 2/209 |
| 4,942,628 | A | | 7/1990 | Freund | |
| 5,044,019 | A | | 9/1991 | Shewchenko | |
| 5,077,836 | A | | 1/1992 | Idoff | |
| 5,191,468 | A | | 3/1993 | Mases | |
| 5,546,610 | A | * | 8/1996 | Herzig et al. | 2/422 |
| 5,571,217 | A | | 11/1996 | Del Bon et al. | |
| 5,619,754 | A | | 4/1997 | Thurwanger | |
| 5,673,431 | A | | 10/1997 | Batty | |
| 5,724,119 | A | | 3/1998 | Leight | |
| 5,752,280 | A | | 5/1998 | Hill | |
| 6,256,798 | B1 | | 7/2001 | Egolf | |
| 6,341,382 | B1 | | 1/2002 | Ryvin | |
| 7,114,197 | B2 | | 10/2006 | Garneau | |
| 7,120,939 | B1 | | 10/2006 | Howard | |
| 7,213,271 | B1 | | 5/2007 | Bielefeld | |
| 7,216,972 | B1 | | 5/2007 | Gelfuso | |
| 8,161,576 | B2 | | 4/2012 | Lemke | |
| 8,745,770 | B2 | * | 6/2014 | Ahlgren et al. | 2/417 |
| 2004/0261158 | A1 | * | 12/2004 | Depew et al. | 2/422 |
| 2006/0225187 | A1 | * | 10/2006 | Wu | A42B 1/22 2/418 |
| 2007/0261153 | A1 | * | 11/2007 | Wise et al. | 2/423 |

FOREIGN PATENT DOCUMENTS

| | | | |
|---|---|---|---|
| CN | 2896924 | | 4/2006 |
| JP | H09-10252 | | 1/1997 |
| WO PCT/AU2007/001260 | | * | 8/2007 |

OTHER PUBLICATIONS

North Safety Products, Fibre-Metal PPE Catalog, 2006, 28 pages.
Huntsman Welding Safety Products Catalog, 2004 8 pages.

* cited by examiner

PIVOTING HEADGEAR SYSTEM

CROSS REFERENCE TO RELATED APPLICATIONS

This application is a national stage filing under 35 U.S.C. §371 of PCT/US2008/078920, filed Oct. 6, 2008, which claims priority to U.S. Provisional Application No. 60/978,829, filed Oct. 10, 2007, the disclosure of which is incorporated by reference in its/their entirety herein.

FIELD

The present disclosure relates to a pivoting headgear system having a lowered axis of rotation and more particularly to a protective pivoting headgear system having a lowered axis of rotation.

BACKGROUND

Protective headgear, for example construction hard hats, helmets, such as fire fighter helmets, shields such as welding shields and grinding shields, sports equipment headgear, and the like often include a headgear support or head suspension. The headgear supports or head suspension often include headbands and/or head straps that are adjustable so that the headgear can be supported comfortably on any size head by the headband.

In many headgear supports or head suspensions, it is desired that the headband be easy to adjust and that it fit adequately without discomfort to the user. In some cases, it is also desired that headgear supports or head suspension headbands do not require that the headgear be removed from the user's head in order to make adjustments in the size of the head suspension. Furthermore, it is desired that the head suspension be comfortable to wear for extended periods of time without excessive need of re-positioning or adjustments. Accordingly, there is a need for head suspensions that are more comfortable to wear for longer periods of time and that are easier to adjust.

BRIEF SUMMARY

The present disclosure relates to a pivoting headgear system having a lowered axis of rotation and more particularly to a protective pivoting headgear system having a lowered axis of rotation.

In a first embodiment, a pivoting protective headgear system includes a head suspension and two transition arms. Each transition arm is coupled to the head suspension and longitudinally extending away from the head suspension. Each transition arm has a distal end and a pivot at the distal end. A protective headgear element is pivotally connected to each pivot.

In another embodiment, a pivoting protective headgear system includes a head suspension and two pivots coupled to the head suspension. Each pivot has an axis of rotation configured to be below any portion of an ear of a user. A protective headgear element pivotally connected to each pivot.

In a further embodiment, a pivoting protective headgear system includes a head suspension having a laterally extending headband and two pivots. Each pivot is spaced apart from the headband and coupled to the headband. The headband is configured to be disposed against a forehead of a user and each pivot has an axis of rotation below the headband. A protective headgear element is pivotally connected to each pivot.

BRIEF DESCRIPTION OF THE DRAWINGS

The invention may be more completely understood in consideration of the following detailed description of various embodiments of the invention in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

In the following description, reference is made to the accompanying drawings that form a part hereof, and in which are shown by way of illustration several specific embodiments. It is to be understood that other embodiments are contemplated and may be made without departing from the scope or spirit of the present invention. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

The present disclosure relates to a pivoting headgear system having a lowered axis of rotation and more particularly to a protective pivoting headgear system having a lowered axis of rotation. This disclosure provides a lowered headgear (e.g., welding helmet or shield, hard hat fire fighter helmets, grinding shields, sports equipment headgear, and the like) pivot axis of rotation of the head suspension, as compared to other designs. This may result in a better-balanced and consequently more comfortable headgear in fixed positions and also during raising and lowering (i.e., pivoting) of the headgear. By lowering the pivot axis of rotation, the headgear and head protection element can operate closer to the user's head and provide for easier maneuvering in narrow spaces. The lower positioned pivot axis of rotation also can lower the adjustment force required to pivot the headgear, by moving the center of gravity of the pivoting headgear element toward the rotation center. While the present invention is not so limited, an appreciation of various aspects of the invention will be gained through a discussion of the examples provided below.

Figure 1:
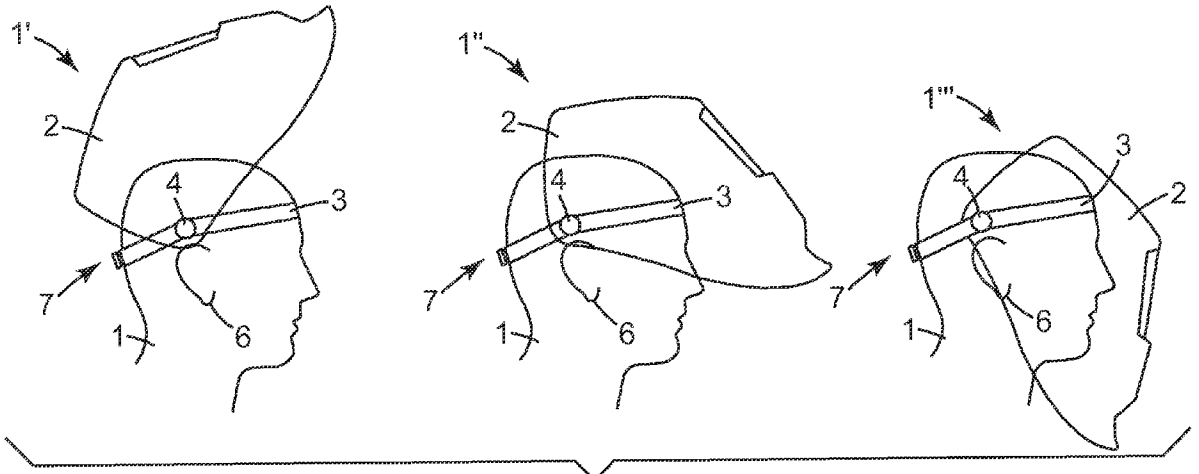
Fig. 1 PRIOR ART
FIG. 1 illustrates schematic side views of a traditional welding shield in a raised position, an intermediate position and a lowered position.

FIG. 1 illustrates schematic side views of a traditional welding shield system 7, which shows a welding shield 2 in a raised position 1', a lowered position 1''', and an intermediate position 1'' on a user 1. Many current designs provide a head suspension headband 3 with a pivot 4 attached on the head suspension headband 3, as illustrated. The pivot 4 provides the axis of rotation allowing the welding shield 2 to pivot between the raised position 1' and lowered position 1'''. These designs feature the pivot 4 axis of rotation located above the user's ear 6 and/or in line with the head suspension headband 3, as illustrated.

Figure 2:
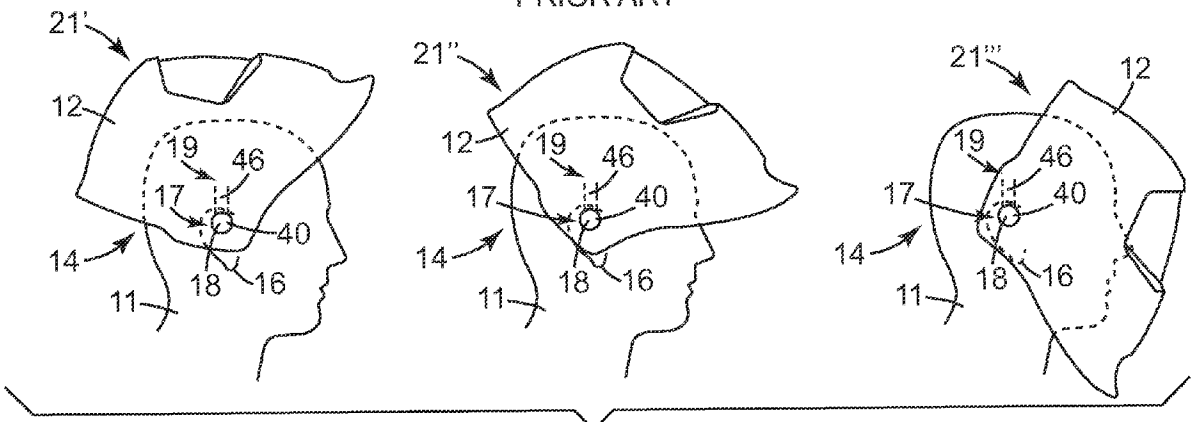
FIG. 2 illustrates schematic side views of an illustrative pivoting headgear according to the present disclosure in a raised position, an intermediate position, and a lowered position.
Figure 3:
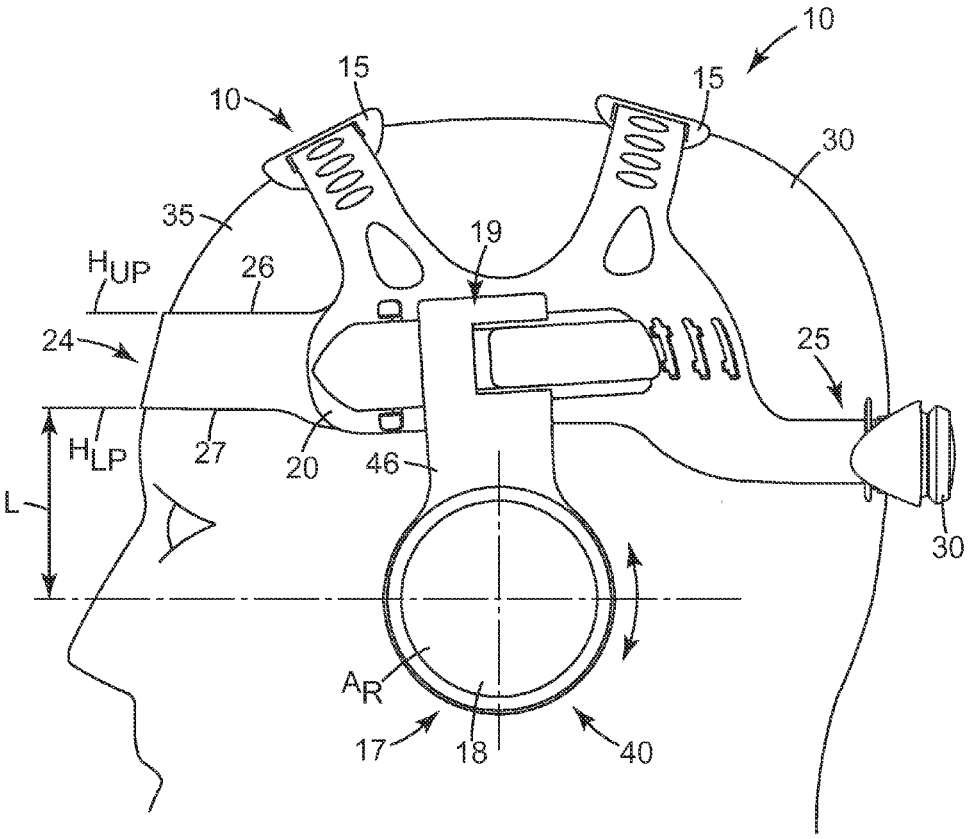
FIG. 3 is a schematic side view of an illustrative head suspension for a pivoting headgear shown in FIG. 2.
Figure 4:
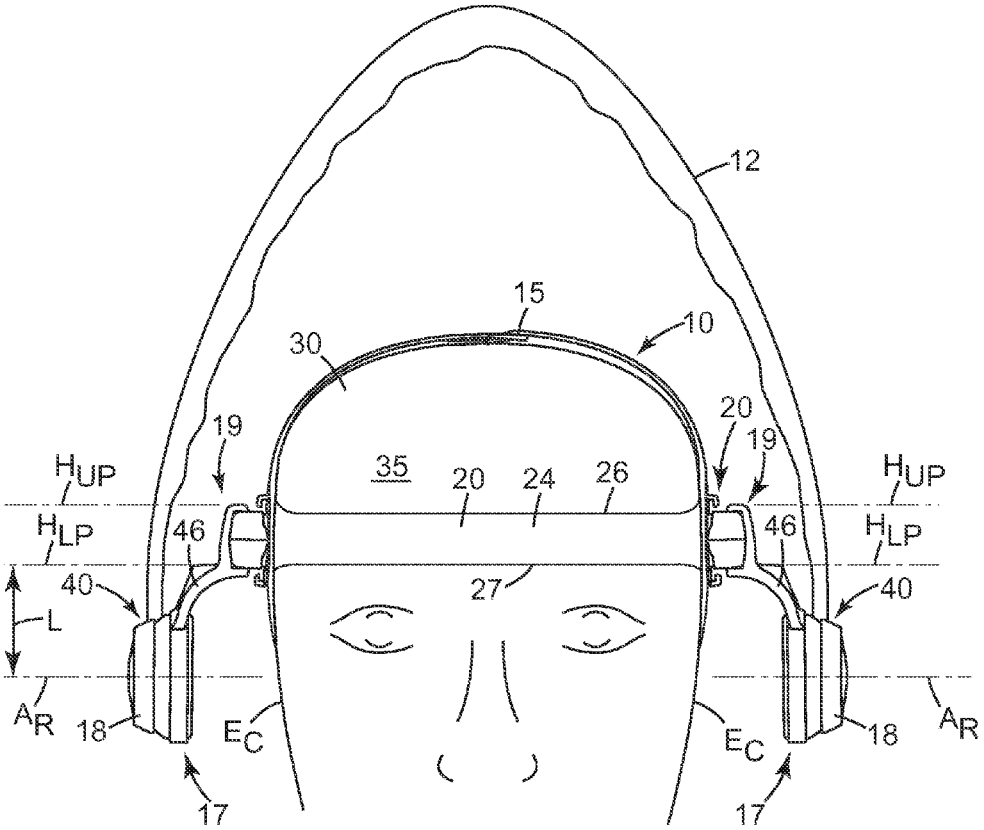
FIG. 4 is a schematic front view of an illustrative head suspension for a pivoting headgear shown in FIG. 2.

FIG. 2 illustrates schematic side views of an illustrative pivoting headgear system 14 which may be a pivoting protective headgear system. The headgear element 12 (which may be a protective headgear element such as a welding helmet or shield, hard hat fire fighter helmets, grinding shields, sports equipment headgear, and the like) of the illustrative pivoting headgear system 14 is shown in a raised position 21', a lowered position 21''', and an intermediate position 21'' on a user 11. This disclosure provides a head suspension headband (shown in more detail in FIG. 3 and FIG. 4) with a pivot 18 placed lower on the user's 11 head than the traditional pivot shown in FIG. 1. The pivot 18 provides the axis of rotation allowing the headgear 12 to pivot between the raised position 21' and lowered position 21'''. In some embodiments, these designs feature the pivot 18 axis of rotation located at or below any portion of the user's ear 16 and/or below the head suspension headband, as illustrated. In particular embodiments, these designs feature the pivot 18 axis of rotation located below the entirety of lower edge 27 of front portion 24, as illustrated in FIGS. 3 and 4. By lowering the pivot 18 axis of rotation, the head protection element 12 can operate closer to the head 11 and provide for easier maneuvering in narrow spaces. The low positioned pivot 18 axis of rotation can lower the adjustment force required to pivot the head protection element 12, by moving the center of gravity toward the rotation center.

FIG. 3 is a schematic side view of an illustrative head suspension for a pivoting headgear shown in FIG. 2. FIG. 4 is a schematic front view of an illustrative head suspension for a pivoting headgear shown in FIG. 2.

The head suspension 10 includes a headband 20 that extends about a user's head 30. The head suspension 10 includes one or more top bands 15 that extend over the user's head 30 and each end of the top band is joined to the headband 20. The head suspension 10 includes a head protection attachment element 40.

The head protection attachment element 40 couples a head protection element 12 (see FIG. 2) to the head suspension 10. In many embodiments, the head protection attachment element 40 pivotally couples the head protection element 12 to the head suspension 10 allowing the head protection element 12 to pivot relative to the head suspension 10. The head protection element 12 can be any useful head protection element such as, for example, a welding helmet or shield, a hard hat, a fire fighter helmet, a grinding shield, sports equipment headgear, and the like. Protective headgear may offer various types and combinations of protection, such as eye protection, head protection, etc.

The attachment element 40 can be any useful element that pivotally couples the head protection element 12 to the head suspension 10 allowing the head protection element 2 to pivot relative to the head suspension 10. Illustrative attachment elements 40 include a fastener that can adjust the frictional engagement between the pivoting head protection element 12 and the attachment element 40.

Two transition arms 46 are attached to the head suspension 10, and in many embodiments, to or at a headband 20 portion of the head suspension 10. The transition arms 46 are coupled to the head suspension 10 and longitudinally extend away from the head suspension 10, as illustrated. Each transition arm 46 is coupled to the head suspension at a proximal end 19 of the transition arm 46 and an opposing distal end 17 of the transition arm 46 includes a pivot 18. The head protection element 12 is pivotally connected to each pivot 18. The transition arms 46 can take any useful form other than the illustrated form.

The headband 20 is an elongated laterally extending element having a band length and includes a front portion 24 and a rear portion 25. The headband 20, which generally may have any useful shape, has an upper edge 26 and an opposing lower edge 27, which may or may not be straight and/or continuous. The headband 20 upper edge 26 defines an upper surface plane $H_{UP}$. The headband 20 lower edge 27 defines a lower surface plane $H_{LP}$. The headband 20 defines a range of lateral planes between the upper surface plane $H_{UP}$ and the lower surface plane $H_{LP}$. The headband 20 front portion 24 is configured to be disposed against a forehead 35 of the user.

Each transition arm 46 longitudinally extends away from the headband 20 any useful length. Each transition arm 46 can have any useful length L defined by a linear distance between the headband 20 lower surface plane $H_{LP}$ to the pivot 18 axis of rotation $A_R$. This length L can be, for example, in a range from 2 centimeters or greater, or 3 centimeters or greater, or in a range from 2 to 10 centimeters, or in a range from 3 to 6 centimeters.

In many embodiments, any portion of the transition arm 46 (such as a distal end of the transition arm 46) extends over and past (i.e., below) any portion of an ear of the user. For example, any portion of the transition arm 46 (such as a distal end of the transition arm 46) may extend below the top edge of an ear of the user. In some embodiments, any portion of the transition arm 46 (such as a distal end of the transition arm 46) extends over and past (i.e., below) an ear canal $E_C$ (i.e., external acoustic meatus) of the user.

The headband rear portion 25 can include an adjustment element 50 configured to adjust a head size of the head suspension 10 with respect to a user's head. One exemplary adjustment element 50 is an adjustment knob providing a ratchet-type head size adjustment as described in U.S. Pat. No. 4,942,628, and incorporated by reference herein to the extent is does not conflict with the present disclosure. However, any other types of adjustments that enable a user to tighten and/or loosen the head suspension 10 about a users head are within the scope of the present disclosure.

Each pivot 18 is longitudinally spaced apart from the head suspension 10 or headband 20 any useful length, L as described above. In many embodiments, the pivot 18 is spaced apart from the headband 20 a length of in a range from 2 centimeters or greater, or 3 centimeters or greater, or in a range from 2 to 10 centimeters, or in a range from 3 to 6 centimeters. In many embodiments, the pivot 18 extends over or past (i.e., below) any portion of an ear of the user. For example, the pivot 18 may be disposed below the top edge of an ear of the user. In some embodiments, the pivot 18 extends over or past (i.e., below) an ear canal $E_C$ (i.e., external acoustic meatus) of the user.

Each pivot 18 has an axis of rotation $A_R$. The axis of rotation $A_R$ is longitudinally spaced apart from the head suspension 10 or headband 20 by any useful length. In many embodiments, the axis of rotation $A_R$ is spaced apart from the headband 20 a length of in a range from 2 centimeters or greater, or 3 centimeters or greater, or in a range from 2 to 10 centimeters, or in a range from 3 to 6 centimeters. In many embodiments, the axis of rotation $A_R$ is spaced apart from the headband 20 lateral plane a length of in a range from 2 centimeters or greater, or 3 centimeters or greater, or in a range from 2 to 10 centimeters, or in a range from 3 to 6 centimeters. In some embodiments, the axis of rotation $A_R$ is spaced apart from the headband 20 lower surface 27 plane $H_{LP}$ a length L in a range from 2 centimeters or greater, or 3 centimeters or greater, or in a range from 2 to 10 centimeters, or in a range from 3 to 6 centimeters. In many embodiments, the axis of rotation $A_R$ extends over and past (i.e., below) any portion of an ear of the user. In some embodiments, the axis of rotation $A_R$ extends over or past (i.e., below) an ear canal $E_C$ (i.e., external acoustic meatus) of the user. In some embodiments, the axis of rotation $A_R$ is within a radius of 30 millimeters, or within a radius of 3 centimeters, or within a radius of 2 centimeters, or within a radius of 1 centimeter of the ear canal of a user.

The lowered pivot axis of rotation, described above can result in better-balanced head protection element in fixed positions and also during raising and lowering (i.e., pivoting) of the head protection element. By moving the center of gravity of the pivoting head protection element toward the rotation center, the lowered pivot axis of rotation can reduce the adjustment force required to pivot the headgear and reduce stresses on the user's head during use and during raising and lowering (i.e., pivoting) of the head protection element.

Thus, embodiments of the PIVOTING HEADGEAR SYSTEM are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A pivoting protective headgear system comprising:

a head suspension having a laterally extending headband adapted to extend about a user's head, which laterally extending headband comprises a front portion that is adapted to be disposed against the forehead of a user;

first and second transition arms that are located on laterally-opposite sides of the headband, each transition arm being non-pivotally connected to the headband of the head suspension at a proximal end of the transition arm, each transition arm longitudinally extending away from the headband to comprise an elongate length and a distal end, and each transition arm having a pivot at the distal end of the transition arm, and wherein the pivot of the first transition arm, and the pivot of the second transition arm, each comprise an axis of rotation that is below the entirety of at least a lower edge of at least the front portion of the headband; and a single protective headgear element that is a welding helmet and that is pivotally connected to the pivot of the first transition arm and to the pivot of the second transition arm, wherein the head suspension comprises a first top band that is adapted to extend over the user's head and that comprises first and second ends each of which are joined to the laterally extending headband; and, a second top band that is adapted to extend over the user's head and that comprises first and second ends each of which are joined to the laterally extending headband, and wherein the first top band and the second top band are non-overlapping top bands, said first and second top bands each having a length, and said first and second top bands spaced apart from one another along their entire lengths, and spaced apart from each other along a front-rear direction of the head suspension, wherein each transition arm has a length in a range from 2 to 10 centimeters, and wherein each pivot exhibits an axis of rotation that is longitudinally spaced away from the headband a distance of from 2 to 10 cm.

2. A pivoting protective headgear system according to claim 1, wherein the first transition arm extends laterally outward from the headband in a direction generally opposite a direction in which the second transition arm extends laterally outward from the headband, wherein the pivot of the first transition arm is adapted to be located laterally outward from any portion of an ear of the user that is nearest to the first transition arm, and wherein the pivot of the second transition arm is adapted to be located laterally outward from any portion of an ear of the user that is nearest to the second transition arm.

3. A pivoting protective headgear system according to claim 1, wherein the headband comprises a rear portion with an adjustment element.

4. A pivoting protective headgear system according to claim 1, wherein the pivots are adapted to allow rotation of the welding helmet at least between a lowered position in which the welding helmet shields the user's eyes and a raised position in which the welding helmet does not shield the user's eyes.

5. A pivoting protective headgear system according to claim 1, wherein the pivoting protective headgear system includes a head protection attachment element that pivotally couples the welding helmet to the head suspension, and wherein the head protection attachment element includes a fastener that can adjust the frictional engagement between the welding helmet and the attachment element.

6. A pivoting protective headgear system according to claim 1, wherein the headband comprises a rear portion with an adjustment element that comprises an adjustment knob providing a ratchet-type size adjustment, which adjustment element is configured to adjust a head size of the head suspension with respect to a user's head.

7. A pivoting protective headgear system according to claim 1, wherein each transition arm has a length in a range from 3 to 6 centimeters, and wherein each pivot exhibits an axis of rotation that is longitudinally spaced away from the headband a distance of from 3 to 6 cm.

8. A pivoting protective headgear system according to claim 1, wherein the length of each transition arm is defined by a linear distance between a lower surface plane defined by a lower edge of the headband and the axis of rotation of the pivot of the transition arm.

9. A pivoting protective headgear system according to claim 1, wherein the pivoting protective headgear system includes a head protection attachment element that pivotally couples the welding helmet to a transition arm of the head suspension, and wherein the head protection attachment element includes a fastener that can adjust the frictional engagement between the welding helmet and the attachment element.

* * * * *